US007891053B2

(12) United States Patent
Schuelke

(10) Patent No.: US 7,891,053 B2
(45) Date of Patent: Feb. 22, 2011

(54) RELEASABLY INTERLOCKING INSTRUMENT HANDLE AND METHOD OF USE THEREOF

(75) Inventor: David A. Schuelke, Stillwater, MN (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 1366 days.

(21) Appl. No.: 11/390,850

(22) Filed: Mar. 28, 2006

(65) Prior Publication Data

US 2010/0011535 A1 Jan. 21, 2010

(51) Int. Cl.
*A47B 95/02* (2006.01)

(52) U.S. Cl. ..... 16/110.1; 16/111.1; 16/406; 16/413; 16/422; 16/426; 16/428

(58) Field of Classification Search ..... 16/110.1, 16/111.1, 406, 413, 422, 426, 428, DIG. 19, 16/DIG. 24, DIG. 25, 2.1; 292/353, 84, 88, 292/89

See application file for complete search history.

(56) References Cited

U.S. PATENT DOCUMENTS

| | | | | |
|---|---|---|---|---|
| 283,134 | A * | 8/1883 | Mills | 292/353 |
| 2,191,294 | A * | 2/1940 | Turner | 403/354 |
| 4,793,363 | A | 12/1988 | Ausherman et al. | |
| 4,838,282 | A | 6/1989 | Strasser et al. | |
| 4,878,156 | A * | 10/1989 | Hallings et al. | 362/109 |
| 5,257,632 | A | 11/1993 | Turkel et al. | |
| 5,385,151 | A | 1/1995 | Scarfone et al. | |
| 5,558,570 | A * | 9/1996 | Nakamura et al. | 451/357 |
| 5,659,927 | A * | 8/1997 | Shanok et al. | 16/412 |
| 5,662,375 | A * | 9/1997 | Adams et al. | 296/214 |
| 5,996,180 | A * | 12/1999 | Eisenzopf | 16/406 |
| 6,270,134 | B1 * | 8/2001 | Lin | 294/16 |
| 6,554,778 | B1 | 4/2003 | Fleming, III | |
| 6,754,935 | B2 * | 6/2004 | Pozgay et al. | 16/422 |
| 6,779,235 | B2 * | 8/2004 | Newman et al. | 16/427 |
| 6,854,919 | B2 * | 2/2005 | Neumann et al. | 403/326 |
| 6,952,862 | B2 * | 10/2005 | Axelsson | 16/422 |
| 7,415,751 | B2 * | 8/2008 | Kato et al. | 24/289 |
| 7,716,790 | B2 * | 5/2010 | Newman et al. | 16/429 |
| 2004/0074051 | A1 * | 4/2004 | Dawson | 16/422 |

* cited by examiner

*Primary Examiner*—Shane Bomar
*Assistant Examiner*—Roberta Delisle
(74) *Attorney, Agent, or Firm*—Martin & Ferraro, LLP

(57) ABSTRACT

In one preferred aspect, a set of interlocking instrument handles is provided that permits a user to directly engage a locking element to releasably lock one instrument to another instrument. In another preferred aspect, a locking collar is provided for locking instrument handles to one another. In a further preferred aspect, a method is provided for locking instrument handles to one another.

18 Claims, 6 Drawing Sheets

RELEASABLY INTERLOCKING INSTRUMENT HANDLE AND METHOD OF USE THEREOF

FIELD OF THE INVENTION

The present invention relates generally to a set of interlocking handles for instruments, and more particularly to a locking system for locking a first instrument to a second instrument.

DESCRIPTION OF THE PRIOR ART

Prior locking mechanisms permit a user to lock a first instrument to a second instrument. One problem associated with many locking mechanisms includes accessibility to the locking mechanism by a user. For example, some locking mechanisms require tugging on the handle of a first instrument in order to pop a pin associated with the first instrument out of a radial notch associated with the second instrument in order to disengage the first instrument from the second instrument. Such a locking mechanism can lead to accidental disassociation of the instruments should the instruments be unintentionally bumped or jarred during use. In the surgical field, this could lead to undesirable consequences.

Another problem associated with many existing locking mechanisms is that the instruments must be visually inspected in order to lock the instruments to one another. In the surgical field, it would be helpful to have an instrument set capable of being locked together where the surgeon need not directly observe the position of one handle relative to another handle in order to lock the instruments to one another.

In view of the problems discussed above, there exists a need for an improved locking system adapted to provide the user with a greater sense of confidence that the instruments will remain locked until the user desires to disengage the instruments from one another.

SUMMARY OF THE INVENTION

The present invention in one preferred embodiment includes a set of interlocking handles for instruments. The set includes a first handle having an enlarged portion, a stem extending from the enlarged portion, and a mid-longitudinal axis through the enlarged portion and the stem. The set also includes a second handle having a gripping portion and a receiving opening adapted to receive at least a portion of the stem of the first handle. A locking element is provided that is adapted to lock the first handle to the second handle. The enlarged portion of the first handle is spaced apart from the second handle longitudinally along the mid-longitudinal axis of the first handle to allow access to the locking element by a user when the stem of the first handle is inserted at least in part into the receiving opening of the second handle and the first and second handles are locked to one another.

In another preferred embodiment, the present invention includes a locking collar for locking a first instrument to a second instrument. The locking collar includes a body having an exterior surface, a distal end, a proximal end, and a passage from the distal end to the proximal end, the passage having a central longitudinal axis and being adapted to receive a portion of the first instrument therein. The locking collar further includes a locking arm extending from the exterior surface of the body, the locking arm being adapted to engage a portion of the second instrument to lock the first instrument to the second instrument, the distal end of the body extending more distally along the central longitudinal axis than the locking arm when the locking arm is engaged with the second instrument.

In a further preferred embodiment, the present invention includes a method for locking a first instrument having a shaft and a handle with a bottom surface to a second instrument having a receiving opening for receiving at least a portion of the shaft of the first instrument. The method includes inserting the shaft of the first instrument at least in part into the receiving opening of the second instrument; locking the first instrument to the second instrument with a locking element while leaving a gap between the second instrument and the handle of the first instrument to permit a user to access a portion of the locking element; and contacting the locking element to unlock the first instrument from the second instrument.

DETAILED DESCRIPTION OF THE PREFERRED EMBODIMENT

Reference will now be made in detail to the present preferred embodiments of the invention, examples of which are illustrated in the accompanying drawings.

FIGS. 1-6 illustrate a set of interlocking handles in accordance with one preferred embodiment of the present invention. Preferably, the set includes at least two instruments, each of which has a handle. One of the handles has a passage adapted to receive a portion of the other handle therein. It will be appreciated by those of ordinary skill in the art that the locking system described below may be adapted for use with a set having more than two instruments.

Figure 1:
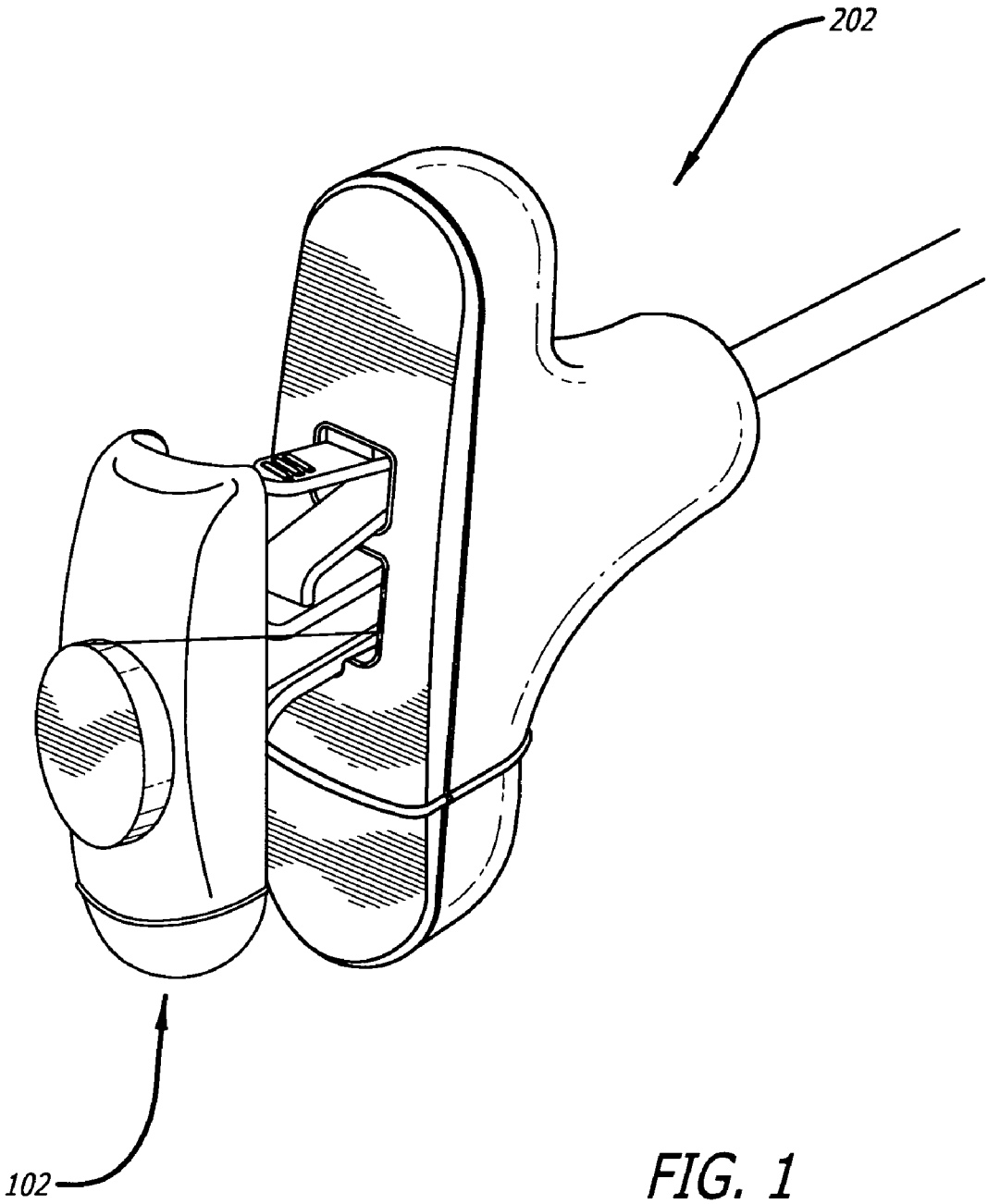
FIG. 1 is a perspective view of a handle releasably locked to a receiving handle in accordance with one embodiment of the present invention.
Figure 2:
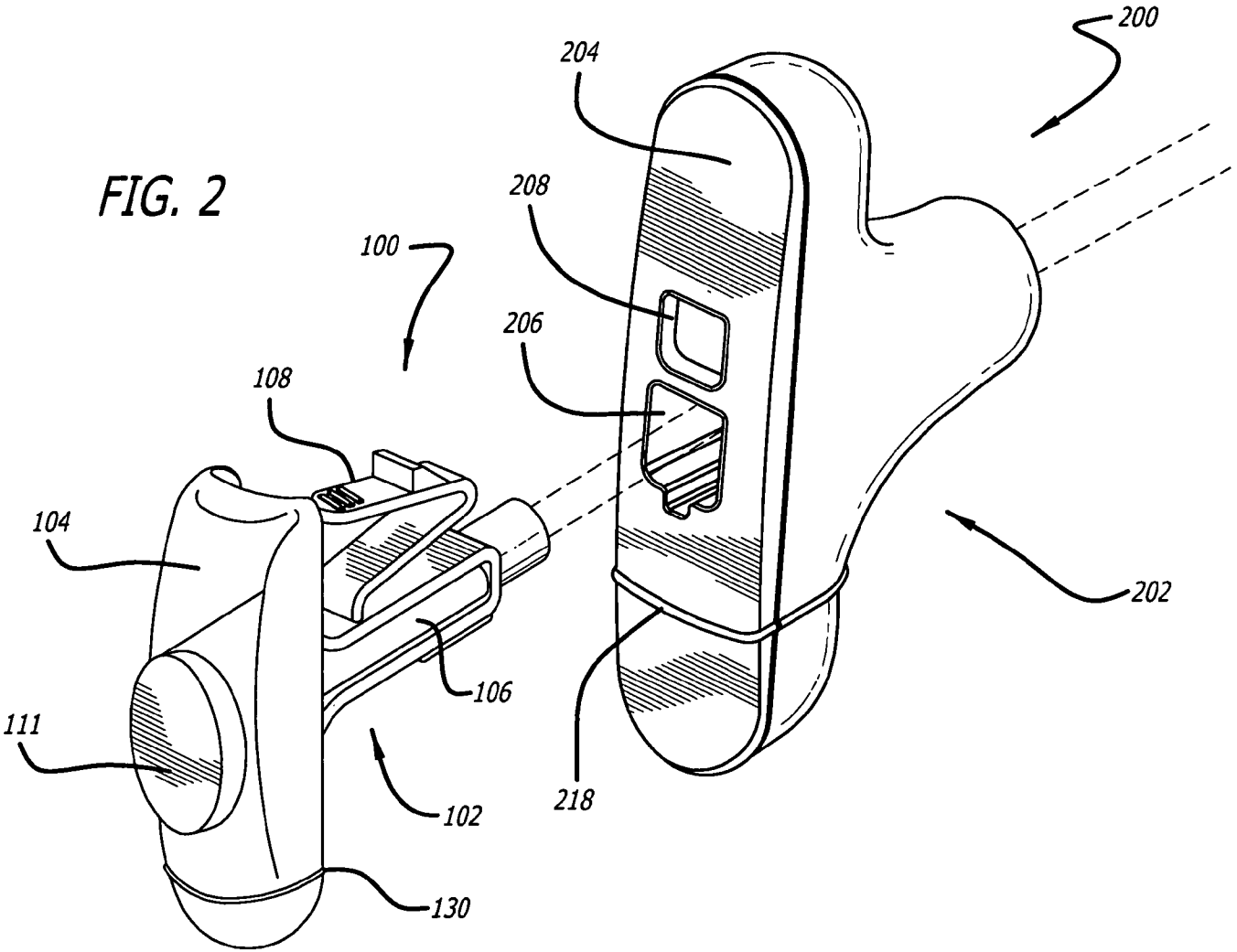
FIG. 2 is a perspective view of the handles of FIG. 1 showing the handle disengaged from the receiving handle.
Figure 6:
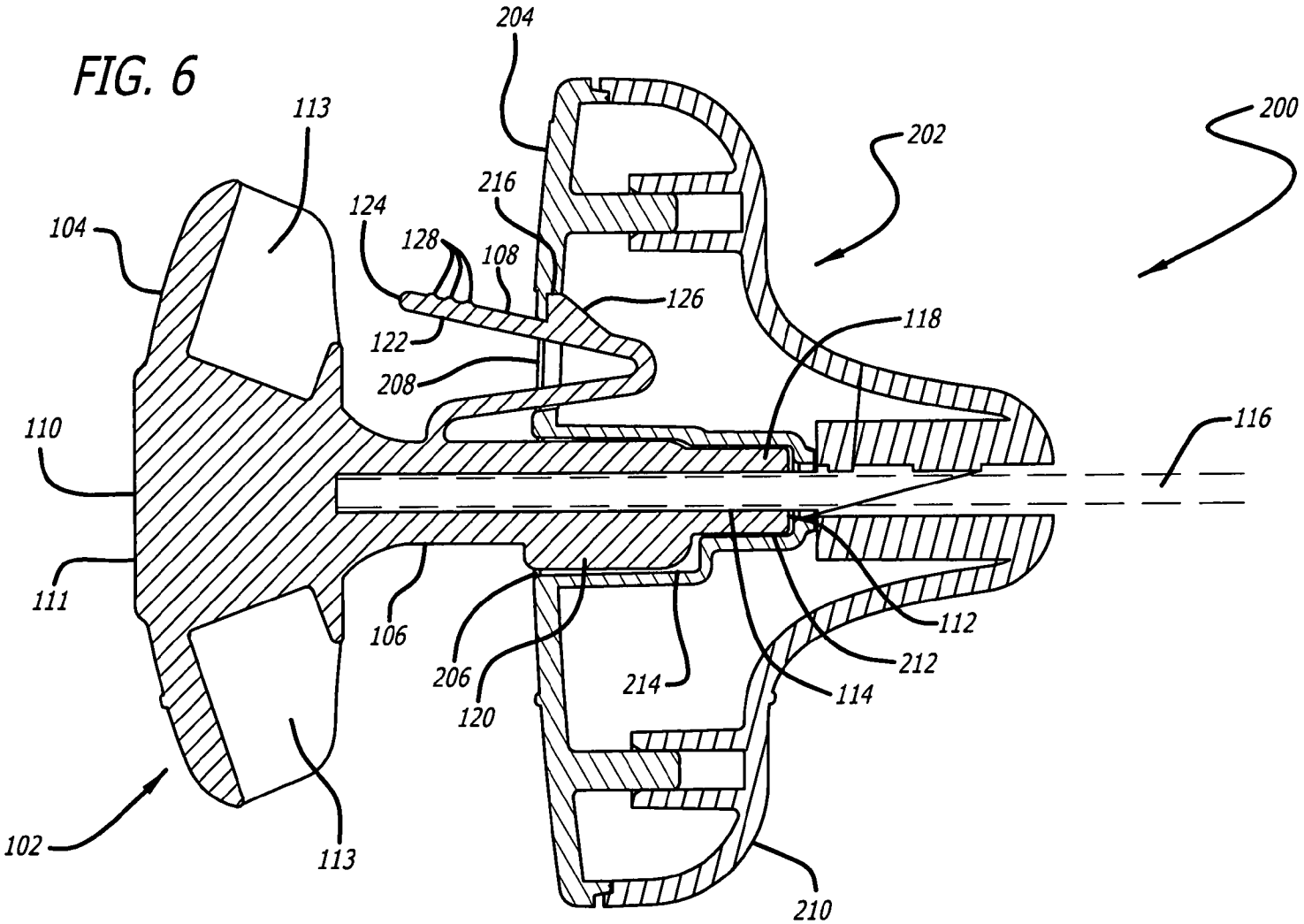
FIG. 6 is a longitudinal cross-sectional view of the handles along line 6-6 of FIG. 5.

FIGS. 1, 2, and 6 show a first instrument 100 having a handle 102 that is slideably engageable into a portion of an instrument 200 having a receiving handle 202. Handle 102 has an enlarged portion 104, a stem 106, a mid-longitudinal axis through enlarged portion 104 and stem 106, and a locking element 108. Receiving handle 202 includes a stem receiving opening 206 adapted to receive at least a portion of stem 106 of handle 102. Receiving handle 202 further includes a locking element receiving opening 208 for receiving locking element 108 of handle 102.

As shown in FIG. 6, enlarged portion 104 of handle 102 includes a top surface 110 that is preferably sized and configured to fit within the palm of a user's hand. The user's fingers grip receiving handle 202 to hold handles 102 and 202 firmly within the user's grasp. Top surface 104 preferably includes an impact receiving area 111 for contacting an impaction device such as a mallet. Handle 102 may include a pair of open areas 113 as shown in FIG. 6. The open areas 113 reduce the amount of material needed to manufacture the handle 102.

Stem 106 of handle 102 has a distal end 112, a recess 114 for receiving a shaft 116, a nose 118, and a keel 120. Nose 118 is preferably at least in part cylindrical while keel 120 preferably has a rectangular shape. It will be appreciated that nose 118 and keel 120 may have other configurations without departing from the scope of the present invention. As will be described below, nose 118 and keel 120 cooperate to allow locking element 108 to be inserted into locking element recess 216 preferably only when first instrument 100 has been moved to a predetermined position relative to second instrument 200.

With reference to FIGS. 2 and 6, locking element 108 includes a locking arm 122 that in one preferred embodiment is generally V-shaped. Locking arm 122 includes a free end 124, a surface protrusion such as a ramp 126, and a finger engagement area 128 which may include a plurality of ridges, protrusions, indentations, or other surface texturing. As will be further described below, when locking arm 122 is inserted within locking element recess 216 of receiving handle 202, ramp 126 slideably engages a recess 216 in top surface 204 of receiving handle 202. While engaging locking element recess 208, locking arm 122 resiliently engages the locking element recess 208.

As shown in FIGS. 2-6, receiving handle 202 further includes a gripping portion 210. Gripping portion 212 is preferably sized and configured to permit the user's fingers to easily grasp handle 202 generally along the mid-longitudinal axis of handle 202. Gripping portion 212 is preferably configured to allow a user to grasp gripping portion 212 with the user's fingers while resting the palm of the user's hand against a portion of top surface 104 of handle 102. Stem receiving opening 206 includes a nose receiving portion 212 and a keel receiving portion 214. Locking element receiving opening 208 includes recess 216 which in one preferred embodiment is formed as a notch.

As shown in FIG. 2, stem receiving opening 206 and locking element receiving opening 208 each preferably have a non-circular cross section transverse to the central longitudinal axis of each of the respective openings. Preferably, the perimeter of each opening is generally square-shaped or rectangular. It will be appreciated and understood by those of ordinary skilled in the art that each of the openings may take a variety of configurations without departing from the scope of the present invention. Stem receiving opening 206 and locking element receiving opening 208 are preferably separated from one another by a portion of top surface 204. In a preferred embodiment, stem receiving opening 206 and locking element receiving opening 208 may be configured to be separated from one another. It will be appreciated that stem receiving opening 206 and locking element recess opening 208 may exist as a single opening rather than being spaced apart from one another.

Figure 3:
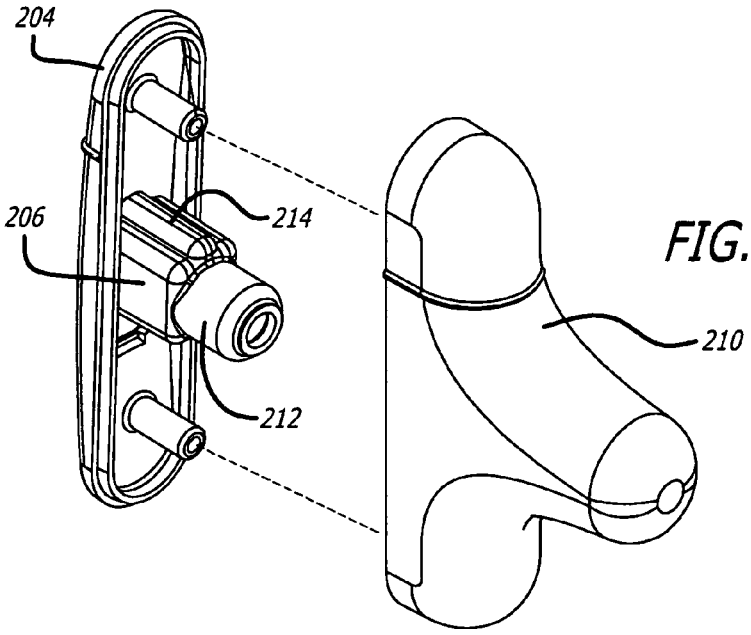
FIG. 3 is an exploded bottom perspective view of the receiving handle of FIG. 1 with a top plate detached from a gripping portion of the receiving handle.

Referring now to FIG. 3, top surface 204 can be a separate piece from gripping portion 210. Top surface 204 preferably includes stem receiving opening 206 and locking element receiving opening 208 formed therein. This has the advantage of permitting receiving handle 202 to be substantially hollow, which decreases materials and costs associated with the manufacture of the handle. It will be appreciated and understood by those skilled in the art that top surface 204 and gripping portion 210 may be integrally formed if desired.

In a preferred method for locking instruments together, a user grips receiving handle 202 of second instrument 200 with the user's index and forefingers about gripping portion 210. The user may engage instruments 100 and 200 together by inserting shaft 116 through stem receiving opening 206 of second instrument 200. Further insertion of instrument 100 into instrument 200 will cause keel 120 of stem 106 of first instrument 100 to come into contact with top surface 204 of second instrument 200. Stem receiving opening 206 is configured such that unless the user properly positions first instrument 100 so that keel 120 is aligned with keel receiving portion 214 of stem receiving opening 206, first instrument 100 cannot be further advanced into receiving handle 202.

Once keel 120 is properly aligned with keel receiving portion 214, handle 102 may be further advanced into receiving handle 202. The positioning of handle 102 in receiving handle 202 allows locking element 108 to align with locking element recess opening 216 to lockably engage first instrument 100 to second instrument 200. Once first instrument 100 is locked to second instrument 200, the locking system prevents rotational movement and longitudinal movement of the first and second instruments relative to one another. Keel 120 permits the user, without direct observation of the relative position of the handles, to lockably engage the handles to one another by rotating the handles relative to one another until the user feels a tactile sensation of the first instrument lockably engaging the second instrument. This feedback provides the user with confidence that the handles are locked to each other.

Though first instrument 100 and second instrument 200 may be locked together without visual observation, the user will preferably look to see the positions of the handles with respect to one another by using indicia on each of the handles, such as ridge 130 on enlarged portion 104 and ridge 218 on top surface 204. When the ridges are longitudinally aligned, the user may be assured that the first and second handles are properly positioned relative to one another to lockably engage the first and second instruments together.

While locking the first instrument to the second instrument, ramp 126 of locking element 108 slideably engages recess 216 to secureably lock the first instrument 100 to the second instrument 200. Once engaged, stem receiving opening 206 blocks further movement of stem 106 into receiving handle 202. The depth of stem receiving opening 206 is such that when the handles are engaged to one another, there will be a predetermined separation space or distance between handle 102 of the first instrument and receiving handle 202 of the second instrument. This predetermined separation space allows direct access by the user to locking element 108.

Figure 4:
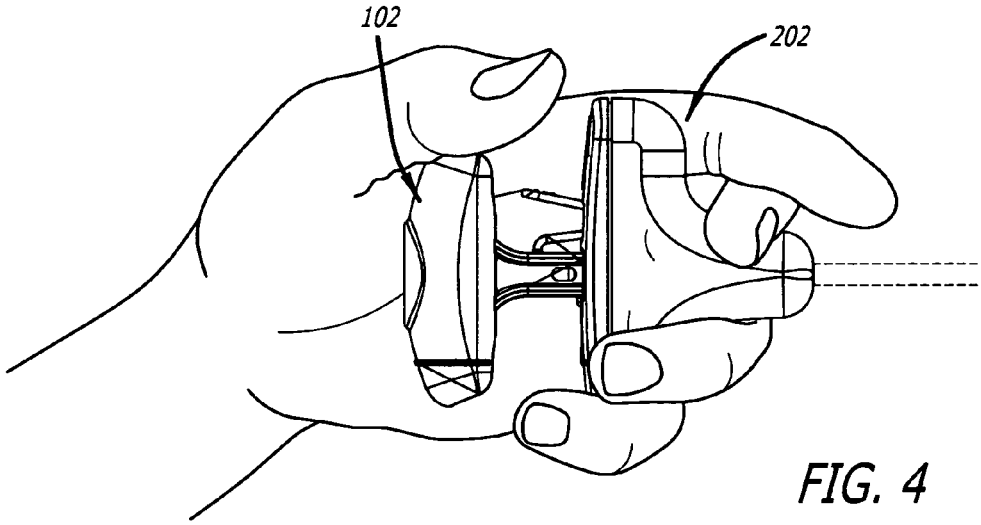
FIG. 4 is a front elevation view of the handles of FIG. 1 lockably engaged to one another.
Figure 5:
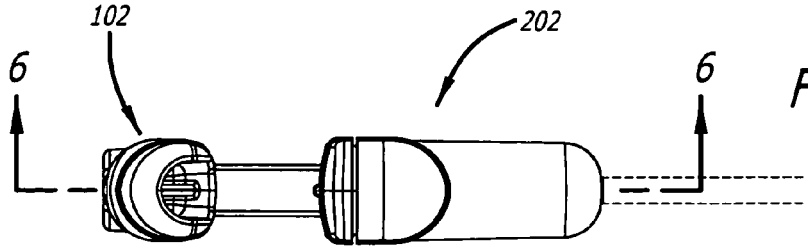
FIG. 5 is a side elevation view of the handles of FIG. 1.

With reference to FIG. 4, to disengage the first and second instruments from one another, the user holds gripping portion 210 of second instrument 200 with at least two fingers while the user's palm rests on top surface 110 of enlarged portion 104 of first instrument 100. The user preferably places another finger at least in part into the separation space on the side of handle 102 which is opposite locking element 108. The user also places the user's thumb at least in part into the separation space on the side of handle 102 that includes locking element 108. The user then presses finger engagement area 128 of locking element 108 towards the mid-longitudinal axis of handle 102 while applying slight upward pressure to handle 102. The inward movement of ramp 126 away from recess 216 releases locking element 108 from receiving handle 202. Thereafter, the user applies further upward pressure on handle 102 to separate first instrument 100 from second instrument 200.

Handles 102, 202, are preferably made of a plastic material. It will be appreciated that handles 102, 202 may be made of metal or any combination of plastic, metal or other material suitable for the intended purpose.

In a preferred embodiment of the present invention, handle 102 of first instrument 100 preferably has a maximum dimension transverse to the mid-longitudinal axis of handle 102 of approximately 2 inches and a minimum dimension transverse to the mid-longitudinal axis of handle 102 in the range of approximately 0.60 to 0.70 inches. Handle 102 preferably has a length from top surface 110 of enlarged portion 104 to distal end 112 of approximately 2.2 inches.

Stem 106 preferably has a length along the mid-longitudinal axis of handle 102 of approximately 1.5 inches. Stem 106 preferably has a minimum dimension transverse to the mid-longitudinal axis of handle 102 of approximately 0.32 inches. Keel 120 preferably extends a distance of approximately 0.25 inches from the mid-longitudinal axis of handle 102.

Locking element 108 preferably extends a distance of approximately 0.64 inches from the mid-longitudinal axis of handle 102. The vertex of ramp 126 is preferably located a distance of approximately 0.80 inches from distal end 112 of stem 106 along a plane parallel to the mid-longitudinal axis of handle 102. Locking element 108 preferably has a total undulated length of approximately 3.9 mm.

Preferably, locking element 108 extends a maximum distance from the mid-longitudinal axis of handle 102 in the range of at least one-third, more preferably at least one-half to the full maximum distance that enlarged portion 104 extends from the mid-longitudinal axis of handle 102. Preferably, locking element 108 has a distance measured parallel to the mid-longitudinal axis of handle 102 that is at least one-half the measured distance of the separation space, at least one half the length of stem 106, and at least one-quarter the length of handle 102 as measured along the mid-longitudinal axis of handle 102.

When the deployer handle is locked to the receiving handle, the separation distance between enlarged portion and top surface 204 is preferably approximately 1.8 mm.

Receiving handle 202 preferably has a maximum dimension transverse to the mid-longitudinal axis of receiving handle 202 of approximately 2.7 inches and a minimum dimension transverse to the mid-longitudinal axis of receiving handle 202 of approximately 0.63 inches. The top of the "T" of gripping portion 210 preferably has a thickness of approximately 0.54 inches parallel to the mid-longitudinal axis of receiving handle 202. The stem of the "T" of gripping portion 210 preferably has a length of approximately 0.9 inches parallel to the mid-longitudinal axis of receiving handle 202. It will be appreciated by those of ordinary skill in the art that the dimensions of the handles may be varied without departing from the scope of the present invention.

Figure 7:
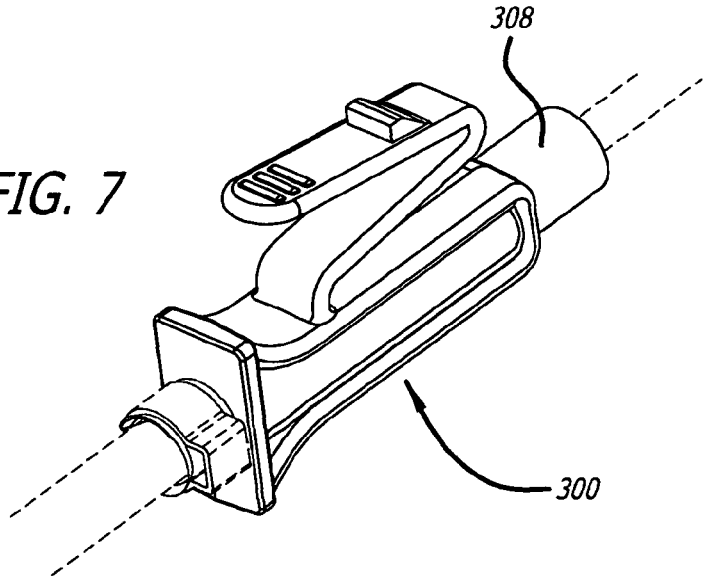
FIG. 7 is a perspective view of a locking collar in accordance with another preferred embodiment of the present invention.
Figure 8:
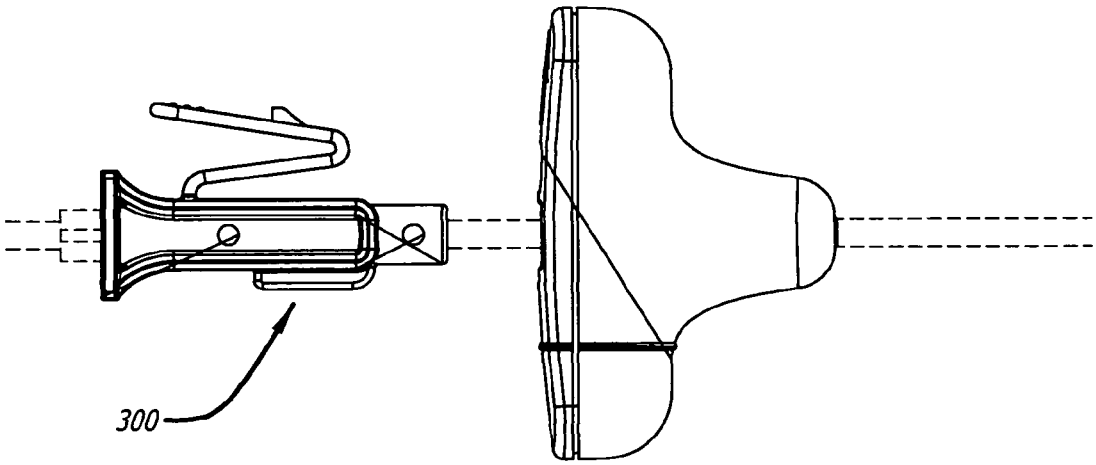
FIG. 8 is a side elevation view of the locking collar of FIG. 7 shown disengaged from a handle of an instrument.
Figure 9:
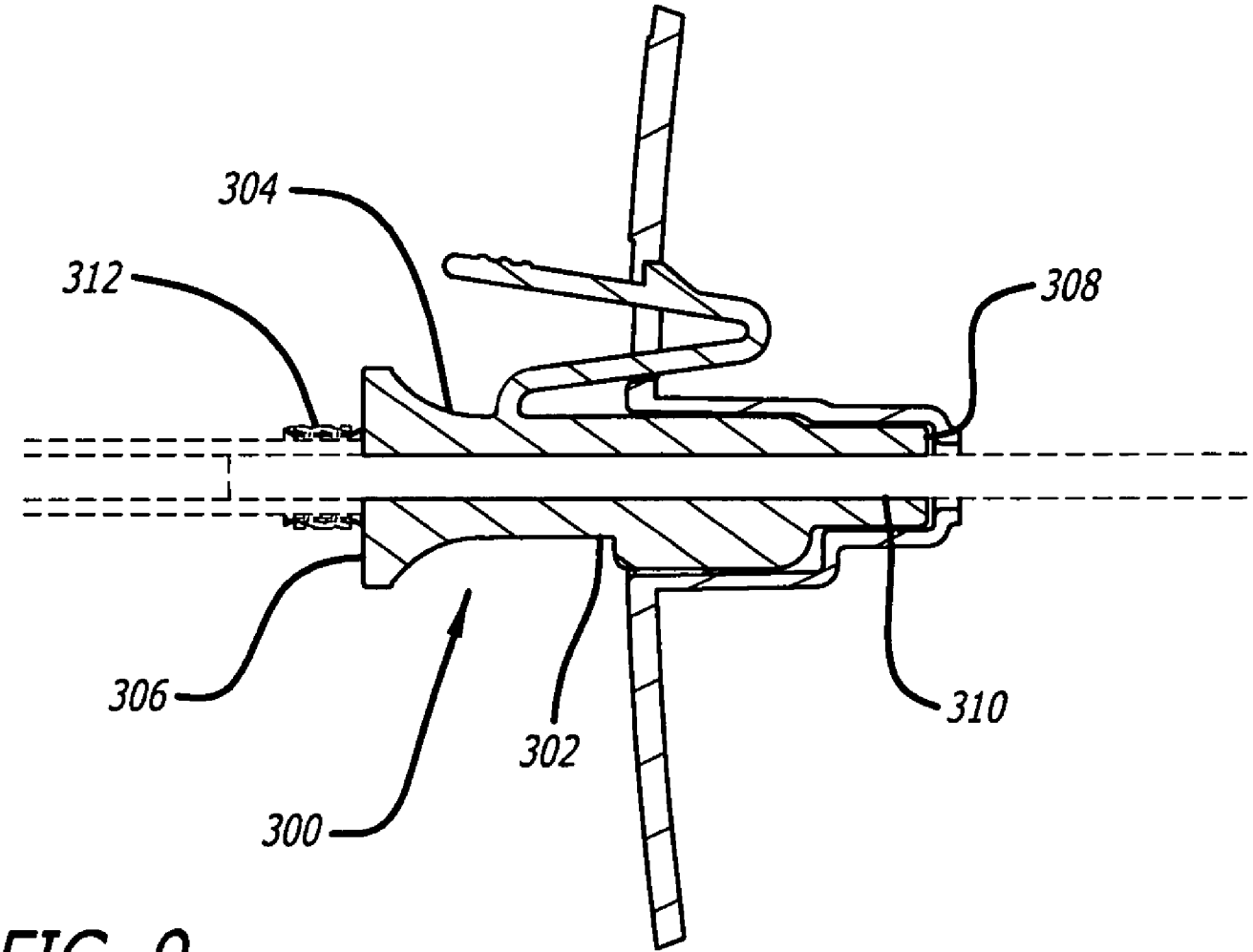
FIG. 9 is a longitudinal cross-sectional view of the locking collar of FIG. 7 shown engaged with the instrument handle of FIG. 8.

FIGS. 7-9 show a locking collar 300 in accordance with another preferred embodiment of the present invention. Locking collar 300 differs from locking element 108 and stem 106 of FIGS. 1-6 in that locking collar 300 may be longitudinally adjustable relative to the shaft of an instrument to lockably engage a first instrument to a second instrument. Locking collar 300 includes a body 302 having an exterior surface 304, a proximal end 306, a distal end 308, and a passage 310 having a central longitudinal axis. Proximal end 306 further includes an engagement area 312 that is preferably configured to fixably engage locking collar 300 to the first instrument. Once properly fixed to the first instrument, locking collar 300 functions in generally the same way as the combination of stem 106 and locking element 108 described above in relation to FIGS. 1-6.

The locking method and system of the present invention is applicable to a variety of instruments. For example and without limitation, first instrument 100 could be a stylet, obdurator, bone tamp, forceps, or any other instrument insertable in a tube having a handle adapted to remain outside the tube. Second instrument 200 could be a cannula, sheath, sleeve, retractor, or any other tubular or cannulated member. It will be appreciated that the locking system of the present invention may be applied to instruments and tools outside the medical field.

Advantages of the present invention include, for example, the ability of the user to lockably engage a first instrument to a second instrument without observation. Since the user has direct access to contact the locking element, the user has greater control over the engagement and disengagement of the first and second instruments relative to one another.

Direct access to the locking element also allows a more positive lock of the first and second element handles relative to one another without an accidental disengagement that may be found in instruments of the prior art.

An advantage of the keel configuration described above and shown in the figures is that the keel allows the user to lockably engage the first and second instruments relative to one another without direct observation of the instruments until the locking element is aligned with the locking element recess receiving opening. In this manner, the user may be assured that a leading end of any instrument inserted through the second instrument may be positioned in a patient in a particular configuration without observing the position of the leading end of the instrument in the patient.

It would be appreciated by those skilled in the art that the present invention described above may take alternative forms without departing from the scope of the present invention. For example, the locking element may be integrally formed with the second instrument instead of the first instrument. The locking element may be biased towards the mid-longitudinal axis of handle 102 instead of away from the mid-longitudinal axis.

It will be understood and appreciated by those skilled in the art that locking element 108 may be configured in a variety of ways without departing from the scope of the present invention. For example only, locking element 108 may include a complete perimeter along its height measured parallel to the mid-longitudinal axis of handle 102, that is, instead of having a free end 124, the locking element may be configured to have a generally C-shaped finger grip handle. Instead of a resilient V-shaped locking element, the locking element may take the form of a spring lock or other equivalent type of lock. Additionally, locking element 108 need not be located on only one side of stem 106. For example, locking element 108 may circumferentially surround stem 106, or exist as two or more projections extending from predetermined locations about the mid-longitudinal axis of handle 102. It is also envisioned that the present invention may have broad applicability beyond the medical field.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A set of interlocking handles for instruments, said set comprising:

a first handle including an enlarged portion, a stem extending from said enlarged portion, and a mid-longitudinal axis through said enlarged portion and said stem;

a second handle including a gripping portion and a receiving opening adapted to receive at least a portion of said stem of said first handle; and a locking element adapted to lock said first handle to said second handle, said enlarged portion of said first handle being spaced apart from said second handle longitudinally along the mid-longitudinal axis of said first handle to allow access to said locking element by a user when said stem of said first handle is inserted at least in part into said receiving opening of said second handle and said first and second handles are locked to one another, said locking element being movable toward the mid-longitudinal axis of said first handle to unlock said first and second handles from one another.

2. The set of claim 1, wherein said locking element is attached to said stem of said first handle.

3. The set of claim 1, wherein said locking element is integral with said first handle.

4. The set of claim 1, wherein said locking element is adapted to resiliently interdigitate with a portion of said second handle.

5. The set of claim 1, wherein said locking element is generally V-shaped.

6. The set of claim 1, wherein a portion of said stem when inserted at least in part into said receiving opening is configured to prevent said locking element from locking said first and second handles together until said stem is rotated to a predetermined position within the receiving opening.

7. The set of claim 1, wherein said second handle includes a locking element receiving opening adapted to receive at least a portion of said locking element, said locking element receiving opening and said receiving opening being spaced apart from one another.

8. The set of claim 7, wherein said locking element includes a surface protrusion adapted to engage with a portion of said locking element receiving opening.

9. The set of claim 1, wherein said enlarged portion of said first handle is spaced apart from said second handle by a separation space dimensioned to permit the user to insert a finger into said separation space to engage said locking element.

10. The set of claim 1, wherein said receiving opening of said second handle is a through-hole.

11. The set of claim 1, wherein said stem of said first handle forms a shaft having an opening coaxial with the mid-longitudinal axis.

12. The set of claim 1, wherein said locking element is a spring lock.

13. The set of claim 1, wherein said locking element receiving opening and said receiving opening of said second handle each have a perimeter, the perimeters of said locking element receiving opening and said receiving opening being in the same plane.

14. The set of claim 1, wherein said first and second handles are made of same material.

15. The set of claim 1, wherein said gripping portion of said second handle is generally T-shaped.

16. The set of claim 7, wherein said second handle includes a top surface and a bottom surface opposite said top surface, said locking element receiving opening and said receiving opening passing through said top surface of said second handle.

17. A set of interlocking surgical instruments, said set comprising:

a stylet having a first handle including an enlarged portion, a stem extending from said enlarged portion, and a mid-longitudinal axis through said enlarged portion and said stem, said stem having at least a portion of a first surgical instrument extending therefrom;

a sleeve having a second handle including a gripping portion and a receiving opening adapted to receive at least a portion of said stem of said first handle and said first surgical instrument, said second handle including a distal end having at least a portion of a second surgical instrument extending therefrom; and a locking element adapted to lock said first handle to said second handle, said enlarged portion of said first handle being spaced apart from said second handle longitudinally along the mid-longitudinal axis of said first handle to allow access to said locking element by a user when said stem of said first handle is inserted at least in part into said receiving opening of said second handle and said first and second handles are locked to one another.

18. A set of interlocking surgical instruments, said set comprising:

a first surgical instrument having a first handle including an enlarged portion, a stem extending from said enlarged portion, and a mid-longitudinal axis through said enlarged portion and said stem, said first instrument having a first distal portion extending from said stem of said first handle, said first distal portion being adapted for insertion into a human body;

a second surgical instrument having a second handle including a gripping portion and a receiving opening adapted to receive at least a portion of said stem and said distal portion of said first instrument, said second instrument having a distal portion extending from said second handle, said second distal portion being adapted for insertion into the human body; and a locking element adapted to lock said first instrument to said second instrument, said enlarged portion of said first handle being spaced apart from said second handle longitudinally along the mid-longitudinal axis of said first handle by a separation space dimensioned to permit the user to insert a finger into said separation space to engage said locking element when said stem of said first handle is inserted at least in part into said receiving opening of said second handle and said handles of said first and second instruments are locked to one another.

* * * * *